United States Patent [19]

Crawford

[11] Patent Number: 4,647,140

[45] Date of Patent: Mar. 3, 1987

[54] ELECTRICAL CONNECTORS

[75] Inventor: Gregan F. Crawford, Edinburgh, Scotland

[73] Assignee: Hewlett Packard Company, Palo Alto, Calif.

[21] Appl. No.: 801,653

[22] PCT Filed: Apr. 4, 1985

[86] PCT No.: PCT/GB85/00151

§ 371 Date: Nov. 25, 1985

§ 102(e) Date: Nov. 25, 1985

[87] PCT Pub. No.: WO85/04768

PCT Pub. Date: Oct. 24, 1985

[30] Foreign Application Priority Data

Apr. 4, 1984 [GB] United Kingdom ..... 8408614

[51] Int. Cl.[4] ..... H01R 13/11

[52] U.S. Cl. ..... 339/176 MP; 339/258 P

[58] Field of Search ..... 339/17 L, 176 MP, 176 MF, 339/258 R, 258 P

[56] References Cited

U.S. PATENT DOCUMENTS 4,087,151 5/1978 Robert et al. ..... 339/176 MP 4,285,565 8/1981 Kirby ..... 339/176 MP

*Primary Examiner*—Joseph H. McGlynn

*Attorney, Agent, or Firm*—Karl E. Bring

[57] ABSTRACT

A printed circuit board connector is disclosed in which contacts of the connector are self-cleaning as the board is inserted into or extracted from the connector.

9 Claims, 13 Drawing Figures

ELECTRICAL CONNECTORS

This invention is concerned with electrical connectors.

In the telecommunications field, especially in the private sector where telephone circuits are provided for continuous use, there is a requirement for accessing and testing these circuits without interrupting them so that they can remain in service and in use while testing takes place. These private telephone circuits, or lines, are not part of the public dial-up network and therefore require specialised testing equipment as is provided, for example, by the Hewlett-Packard HP37100 series remote access testing system.

It is a primary requirement that the test equipment must be installed in a circuit so that it can be disconnected from or connected into that circuit without breaking transmission in that circuit. To achieve this, the test equipment typically comprises a number of "access cards" which can be connected into the circuit to be tested, each access card having mounted thereon a plurality of relays, the relays operating in a manner such as to maintain continuity of circuit, and to switch the circuit to the test equpment as hereinafter described. Each access card is essentially a printed circuit board having conductive traces thereon leading to and from relays mounted on the board and extending to an edge of the board on both surfaces thereof. The traces thus provide edge connectors along the edge of the board, which edge connectors are arranged to be held in electrically-conductive spring clips which provide normally contacting jaws when the board is not urged therebetween and can be forced apart by the edge of the board when the test equipment is connected in circuit.

BRIEF DESCRIPTION OF THE DRAWINGS:

FIG. 1 is a schematic circuit diagram which illustrates the principle of interconnection of an access card in a single circuit line, of which in practice there are many. The line 100 includes a spring clip indicated by the box 102, the clip comprising jaws indicated by the two arrowheads 104, 106. As illustrated in FIG. 1, the jaws 104, 106 are sprung apart and make contact with edge connectors 110, 112 on opposite surfaces of a circuit board, the connectors being electrically connected to relays RL1, RL2 mounted on the board.

Figure 1:
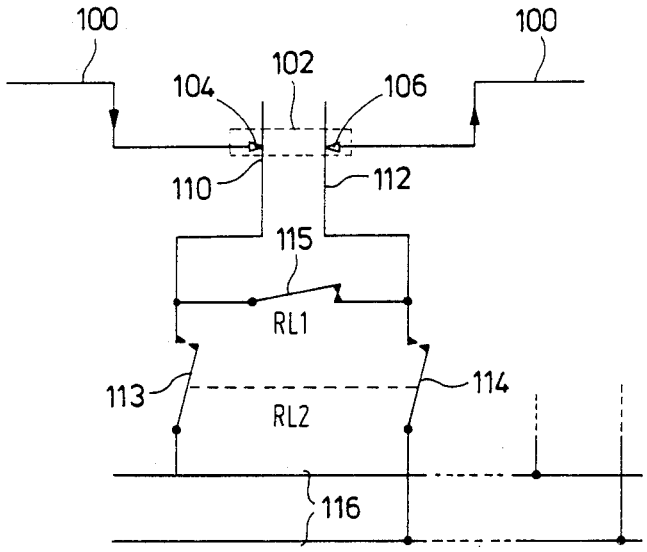
FIG. 1 is a schematic circuit diagram of an access card in a single circuit line.

Provided that the jaws 104, 106 make good electrical contact with the connectors 110, 112 continuity is maintained in the line 100 via the closed contact 115 of the relay RL1, while the contacts of the relay RL2 remain open. When it is desired to test the circuit, the contacts of the relay RL2 are closed and those of the relay RL1 are opened to divert the circuit through an access bus 116 to test equipment provided at a remote location. In normal operation, the circuit is maintained through the contact 115 of the relay RL1 and only for occasional intervals is the circuit switched through the relay RL2 to the remote test equipment. Occasionally, a component, e.g. a relay, of an access card can fail and at that point in time it is necessary to withdraw the access card from use. At this point the access card is physically moved so that the edge connectors thereof are withdrawn from between the jaws of the spring clip, the design of the spring clip being such that the jaws make contact with each other before becoming disconnected from the connectors, thereby preserving circuit continuity. However, with current spring clip design, it is possible that dirt can collect on the jaws of the spring clip and prevent closing of the circuit, thereby disrupting flow of information therethrough. This problem will become more clear from reference to FIGS. 2, 3*a*–3*c*, 4*a*–4*c* and 5*a*, 5*b* which illustrate an element of a typical prior art spring clip and the potential problem that may arise due to ingress of dirt or due to corrosion on the jaws of the clip.

Figure 2:
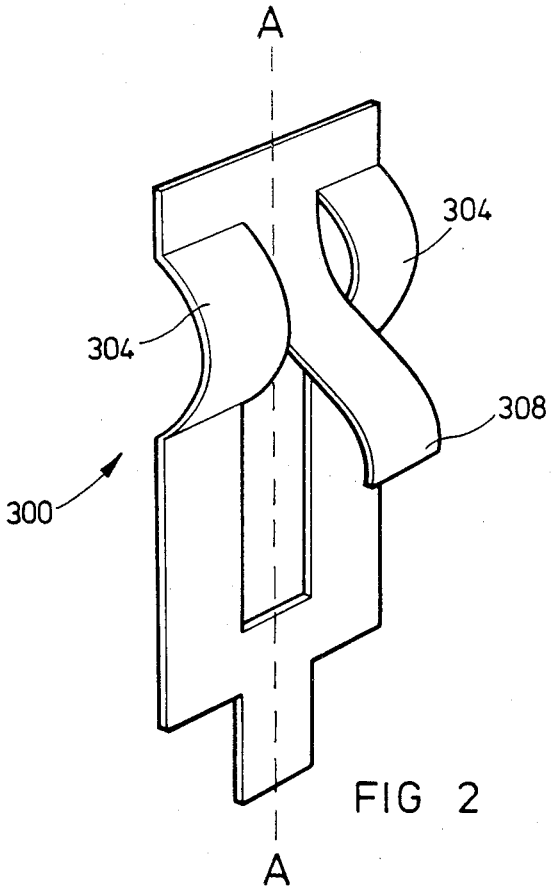
FIG. 2 depicts an element of a prior art spring clip.
Figure 3A:
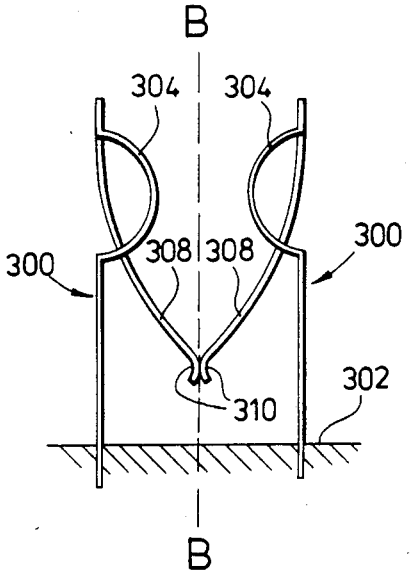
FIGS. 3*a*, 3*b*, and 3*c* depict an edge portion of a circuit board in progressive stages of insertion into a prior art spring clip.

The prior art clip comprises two elements 300 such as are shown in FIG. 2, the two elements being mounted in face-to-face relationship, as indicated in side elevation in FIG. 3*a*. Each element is made of electrically-conductive material, and the two elements are mounted a distance apart from each other on an insulating base 302 such that the shortest distance between opposed arched portions 304 of the elements is less than the thickness of a printed circuit board 306 to be inserted therebetween, and such that the two leaf-spring portions 308 of the opposed elements are urged against each other adjacent their extremities 310.

Figure 3B:
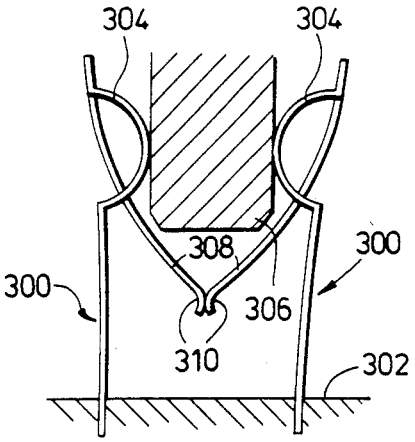
Figure 3C:
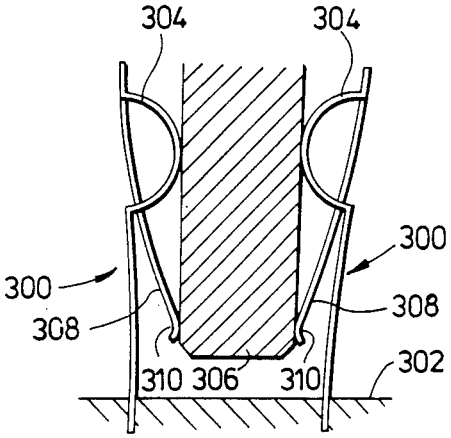

As the edge portion of a circuit board is inserted into the spring clip, the elements of the clip flex apart as shown in FIGS. 3*b* and 3*c*, until the board is located between the elements. Insertion of the board can be considered as a two-stage process, in the first stage of which, as the board is urged between the arched portions 304, continuity of the circuit is maintained through the leaf-spring portions 308 which remain in contact and through the closed contact of relay RL1 of FIG. 1. In the second stage, continuity of circuit is transferred entirely to the contact of relay RL1. The reverse is true when the board is withdrawn from the clip.

It will be seen from FIG. 2 that the geometry of each element is symmetrical about the line A—A and from FIG. 3*a* it can also be seen that the geometry of the clip is also symmetrical about the plane B—B normal to the paper. The symmetry of this arrangement can cause a number of different problems, all of which can adversely affect continuity of circuit.

When the printed circuit board is removed, circuit integrity relies on only one contact from each side of the make-before-break connector provided by the clip, i.e., the leaf-spring portion 308 of each connector. This means that if any dirt or detritus, such as glass fibre from the printed circuit board or corrosion products, becomes trapped between the contacts provided by the leaf-spring portions 308, the circuit will not close and will remain open. In a private circuit telephone line, used for transmission of data from one computer installation to another, such an open circuit may remain open until detected with consequent loss of valuable data.

Figure 4A:
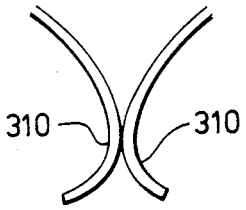
FIGS. 4*a* and 4*b* depict the extremities of leaf-spring portions of a prior art spring clip in exaggerated form as the clip is sprung.
Figure 4B:
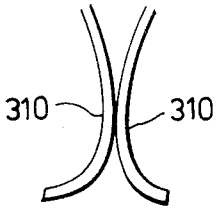

The second problem which can arise with such an arrangement as is provided by the prior art, is that as the clip is sprung, the extremities 310 of the leaf-spring portions 308 will roll against each other, as shown in exaggerated form in FIGS. 4*a* and 4*b*. There will be no self-cleaning between these end portions and particles may even become trapped between them to be ground into the surfaces thereof.

Figure 5A:
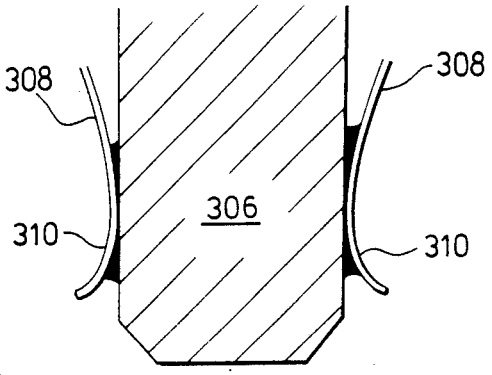
FIGS. 5*a* and 5*b* depict examples of corrosion build-up between a circuit board and leaf-spring portions of a prior art spring clip while the circuit board is inserted, and corrosion build-up between leaf-spring portion of a prior art spring clip after the circuit board is removed.
Figure 5B:
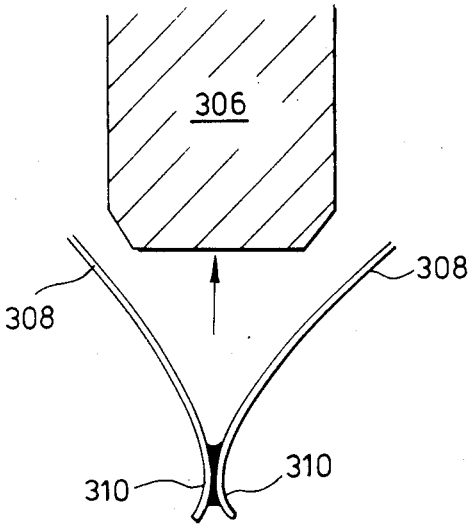

The third problem that can occur is also a result of the environment in which access to a circuit line is available. If a printed circuit board has been mounted in a plurality of clips for a sufficient period of time in an industrial environment, it is very possible that corrosion products may form on the leaf-spring portions 308 or that dirt deposits may build up between the board 306 and the leaf-spring portions. Whilst this may be satisfactory whilst the board is in situ and will not adversely affect the quality of electrical contact, as soon as the board is removed, there may be a tendency for the board to drag the deposits from a position in which they may do no harm onto the face of the actual contact area so that the deposits are exactly where they should not be when the board is removed. Furthermore, corrosion products may build-up at the end of a conductive trace on the board where the material of the trace is exposed. This may lead, on withdrawal of the board, to the corrosion products being dislodged and becoming trapped between the ends of the leaf-spring portions, thus preventing the leaf-spring portions from coming into contact. These effects are shown in FIGS. 5*a* and 5*b*.

The present invention provides an electrically-conductive, resiliently-flexible element for use in a connector comprising that element and a second electrically-conductive, resiliently-flexible element, the second element comprising three in-line elongate portions, which are integrally connected in coplanar relationship by a bridge portion, the third elongate portion extending between the other two elongate portions from the bridge portion as a curved leaf-spring portion, and the two elongate portions being formed adjacent the bridge portion each with an arch portion, said second element further comprising a mounting portion, integrally formed with the elongate portions and the bridge portion, and said element comprising three in-line elongate portions integrally connected by a bridge portion, the element further comprising a laterally-extending portion and a mounting portion, said element being characterized in that two of said elongate portions are formed as curved leaf-spring portions lying in parallel relationship and the third of which is positioned between the leaf-spring portions, the construction and arrangement of said element being such that it can be mounted in face-to-face relationship with the second element, with the leaf-spring portions of said element extending to make electrical contact with the planar portions of the second element, the leaf-spring portion of the second element making electrical contact with the third portion of said element and the laterally-extending portion of said element facing the arch portions of the second element, whereby, when a printed circuit board is inserted between the elements, the arch portions and the laterally-extending portion are urged apart, thus causing end portions of each leaf-spring portion to wipe against surface portions of the opposed elongate portions to provide self-cleaning of the contacting surfaces.

In an element as set forth in the last preceding paragraph, it is preferred that the laterally-extending portion of the element is formed as an arch portion between the bridge portion and the elongate planar portion. Alternatively, the laterally-extending portion of the element is provided by the bridge portion.

Preferably, the end portions of the leaf-spring portions of the element are bent to provide shoe portions which can rub against the surface portions of the corresponding elongate planar portions.

The present invention further provides a connector for connection to conductive traces on an edge portion of the printed circuit board, the connector comprising first and second spaced, electrically-conductive, resiliently-flexible elements each of which comprises three in-line elongate portions integrally-formed with a bridge portion, inwardly-facing, laterally-extending portions, and a mounting portion, the elongate portions of the first element providing two coplanar portions and a curved leaf-spring portion extending from the bridge portion toward the second element, and two of the elongate portions of the second element providing a planar portion including said mounting portion and a curved leaf-spring portion, the connector being characterized in that the third elongate portion of the second element is also formed as a curved leaf-spring portion with the planar portion between the two curved leaf-spring portions, the construction and arrangement being such that, when the first and second elements are mounted in face-to-face relationship to receive an edge portion of a printed circuit board, the leaf-spring portions extend to make electrical contact with the planar portion(s) of the opposed element, and the spacing of the opposed laterally-extending portions being such that they are urged apart by insertion, and flex together on extraction, of a circuit board therebetween to cause end portions of the leaf-spring portions to wipe against surface portions of the elongate portions to provide self-cleaning of the contacting surfaces.

In a connector as set forth in the last preceding paragraph, it is preferred that the laterally-extending portions of the first and second elements are formed as arch portions. Alternatively, each laterally-extending portion is provided between a respective elongate planar portion and in the respective bridge portion.

Preferably, each laterally-extending portion is provided by the bridge portion of the respective element.

The present invention also provides means for connecting circuit means to components on a printed circuit board, said means comprising a plurality of connectors as set forth in the last preceding paragraph but two and arranged in a linear array for receiving and making electrical contact with conductive traces provided along an edge portion of the circuit board and electrically connected with said components.

There now follows a detailed description which is to be read with reference to FIGS. 6 to 9 of the accompanying drawings of a connector and an element according of the invention; it is clearly understood that the connector and the element have been selected for description to illustrate the invention by way of example and not by way of limitation.

Figure 6:
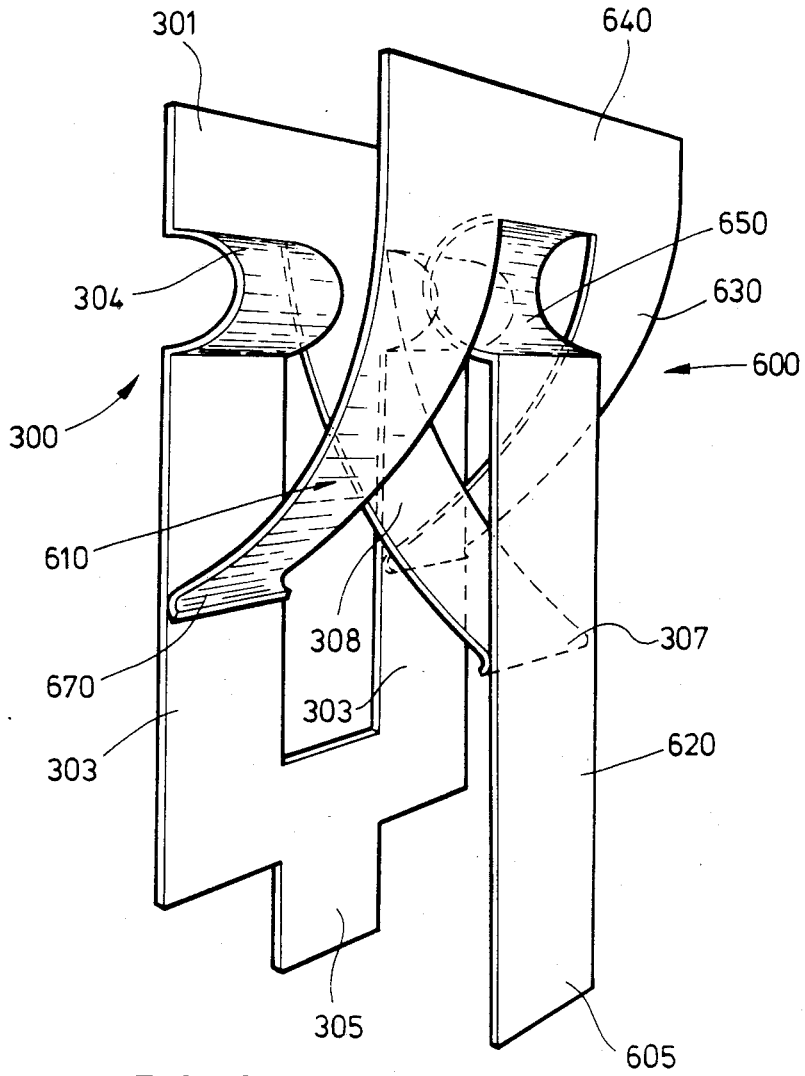
FIG. 6 shows a perspective view of a connector according to the invention.
Figure 7:
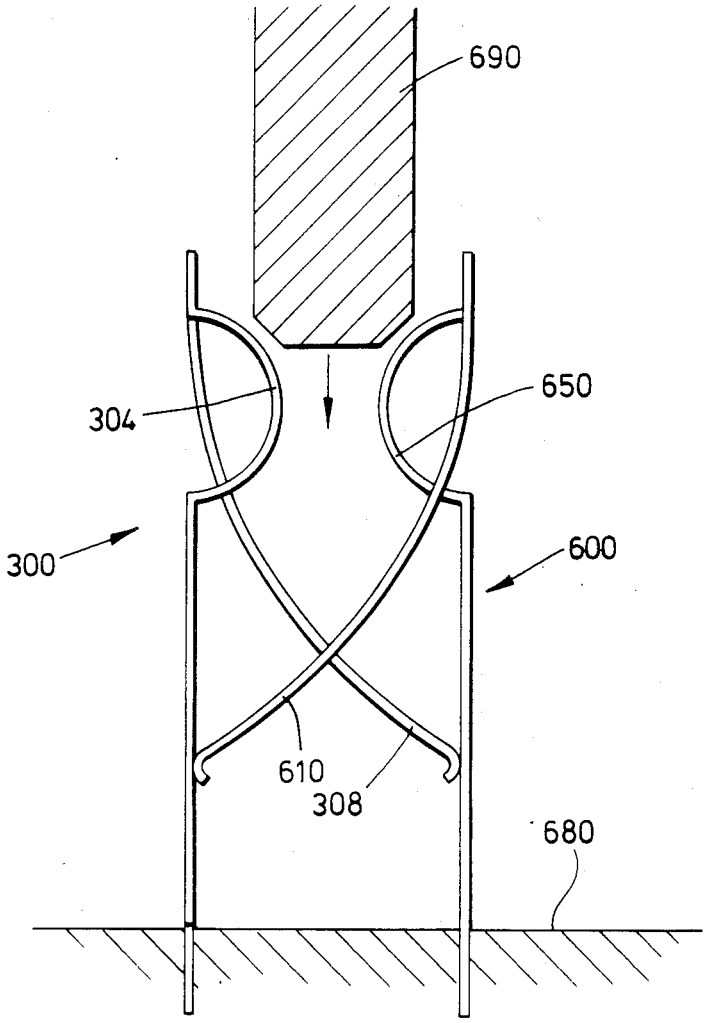
FIG. 7 shows a side view of a connector according to the invention in a relaxed condition.
Figure 8:
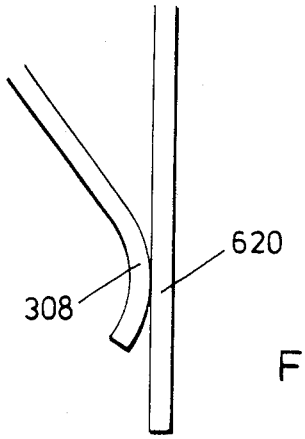
FIGS. 8 and 9 show exaggerated views illustrating a characteristic feature of the present invention.
Figure 9:
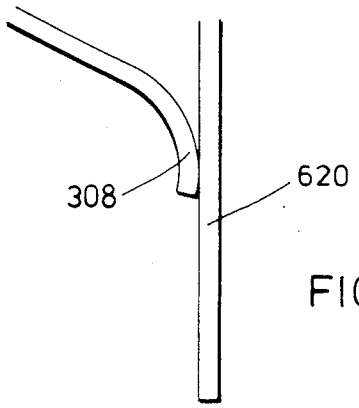

FIG. 6 is a perspective view of a connector according to the invention;

FIG. 7 is a side view of a connector according to the invention in a relaxed condition; and FIGS. 8 and 9 are exaggerated views illustrating a characteristic feature of the present invention;

The connector shown in FIGS. 6 and 7 comprises a first element 300, which is similar to the prior art element shown in FIG. 2, and a second element 600 which can be considered as complementary to the element 300. The two elements are formed of metal or metal-coated plastics material, which is resiliently flexible. The element 600 comprises three elongate portions indicated generally at 610, 620 and 630 which are integral with a bridge portion 640.

In the relaxed condition shown in FIG. 6, the bridge portion 640 and the mounting portion 620 are coplanar. The elongate, central, portion 620 comprises an arched portion 650 integral with a planar mounting portion 660. The portion 620 is flanked by the two portions 610 and 630, each formed as a curved leaf-spring curving from the bridge portion 640 in the same direction as the arched portion 650 away from the plane defined by the portions 620 and 640. The leaf-spring portions 610 and 630 each terminate as a shoe portion 670.

In use, the element 600 is mounted on a base 680 in face-to-face, opposed relationship with the element 300 to provide a connector as shown in FIG. 7, with the mounting portions also providing terminal pads for connection of the circuit board connected in a transmission line. The two elements provide the jaws 104, 106 of the spring clip 102 shown in FIG. 1.

The two elements are so mounted that the elongate portions of the element 300 are in face-to-face relationship with the leaf-spring portions 610, 630 of the element 600, while the latter's leaf spring portion is in like relationship with the mounting portion 620, the separation of the mounting portions being such that the shoe portions of each leaf-spring portion bears positively against the planar portion(s) of the other so that electrical contact is achieved therebetween, providing three contact areas as opposed to the single contact area achieved by the prior art (see FIG. 3*a*). The distance of separation of the arched portions 304, 650 is less than the thickness of a printed circuit board to be inserted therebetween.

The edge portion of a printed circuit board 690 is inserted between the two elements and forces them to flex or bend outwardly as the arched portions 304, 650 are urged apart. This movement of separation causes the shoe portions of each element to slide, upwardly viewing FIG. 7, along the surface of planar portion. In the illustrated construction, the movement of separation of the arched portions 304, 650 is substantially arcuate. Thus, as the upper extremities, viewing FIG. 8, of the arched portions 304, 650 move apart, the shoe portions of the leaf-spring portions wil follow the movement and be drawn along the surfaces of the planar portions, due to the change in attitude of the leaf-spring portions.

The effective movement of the shoe portions along the surfaces is shown by the illustration in exaggerated form in FIGS. 8 and 9 of the movement of a shoe portion against the opposed planar portion 620, FIG. 8 showing the relationship when the connector is in its relaxed state (that of FIG. 6) and FIG. 10 showing the relationship when the elements of the connector are urged apart. Between these two positions, each shoe portion will effect a sliding, scraping motion against the curved portion while changing its attitude so as to effect a self-wiping action between mutually self-contacting portions of the shoe portion and the surface of the planar portion.

As the edge portion of the printed circuit board is urged between the arched portions 304, 650, the arched portions make electrical contact with electrically-conductive traces on the board whilst the shoe portions maintain contact with the planar portions. Continuity of circuit is thus maintained through the three leaf-spring portions contacting the opposed elements and the normally-closed contact of the relay on the board which is equivalent to the relay RL1 of FIG. 1.

When the edge portion of the board is urged further into engagement with the spring clip connector, the leaf-spring portions 308, 610, 630 are themselves sprung apart and make electrical contact with the traces on each side of the board, so that continuity of the circuit is transferred to the circuit board, specifically through the relay RL1.

The self-wiping facility of the elements of the connector is of great significance when, for whatever reason, it is desired to withdraw the board from the connector, e.g., to replace a defective relay. At this stage is is critical that, when the board is partially withdrawn, the leaf-spring portions 308, 610, 630 make good electrical contact with the opposite planar portions for otherwise, when the circuit board is fully withdrawn from the connector, the circuit will be broken.

As will be seen by reference again to FIGS. 8 and 9, aggregation of dirt or corrosion can be removed by the scraping motion of the shoe portions of each leaf-spring portion along the surface of the curved portion, as the shoe portion moves from the position shown in FIG. 9, which is the position adopted immediately the leaf-spring portions have been released from engagement with the printed circuit board, to the position shown in FIG. 8.

The planar portions of the two elements may include curved portions against which the shoe portions can wipe, in the manner disclosed in the specification of our copending UK patent application No. 8407948.

It is believed that the curvature of the curved portion of each element provides for a more variable geometry thus allowing for a larger surface area of each shoe portion to be cleaned. Obviously, the geometry of the portions of the individual elements can be varied according to requirements.

What is considered to be important, however, is the construction of the individual elements whereby a sliding movement of contacting portions of the opposed elements can be obtained.

In an alternative embodiment (not shown) to that shown in FIGS. 6 to 8, it would be possible to make elements similar to elements 300 and 600, but which had the upper extremity of each arch portion free and the bridge portion 640 of the element 600 (and the equivalent bridge portion of the element 300) integrally formed immediately below the arch portion(s) of each element, so that the leaf spring portions 308 and 610 extend outwardly from below the level of the arch portions 304 and 650.

In a further alternative embodiment (not shown) of the present invention, the arch portion 650 of the element 600 may be provided by the bridge portion itself, so that the functions of the two portions are performed by the one portion. Similarly, the two arch portions 304 of the element 300 of a connector according the the invention may also be provided by the bridge portion of that element.

I claim:

1. An electrically-conductive, resiliently-flexible element for use in a connector comprising that element (600) and a second electrically-conductive, resiliently flexible element (300), the second element comprising three in-line elongate portions (303,308,303), which are integrally connected in coplanar relationship by a bridge portion (301), the third elongate portion (308) extending between the other two elongate portions (303) from the bridge portion as a curved leaf-spring portion, and the two elongate portions (303,303) being formed adjacent the bridge portion each with an arch portion (304), said second element further comprising a mounting portion, integrally formed with the elongate portions and the bridge portion, and said element (600) comprising three in-line elongate portions (610, 620,630) integrally connected by a bridge portion (640), the element further comprising a laterally extending portion (650) and a mounting portion, said element being characterized in that two of said elongate portions (610, 630) are formed as curved leaf-spring portions lying in parallel relationship and the third (620) of which is positioned between the leaf-spring portions the construction and arrangement of said element being such that it can be mounted in face-to-face relationship with the second element, with the leaf-spring portions (610,630) of said element extending to make electrical contact with the planar portions (303,303) of the second element, the leaf-spring portion (308) of the second element making electrical contact with the third portion (620) of said element and the laterally-extending portion (650) of said element facing the arch portions (304) of the second element, whereby, when a printed circuit board is inserted between the elements (300,600), the arch portions (304) and the laterally-extending portion (650) are urged apart, thus causing end portions of each leaf-spring portion (307,670) to wipe against surface portions of the opposed elongate portions (620,303) to provide self-cleaning of the contacting surfaces.

2. An element according to claim 1 characterized in that the laterally-extending portion (650) of the element is formed as an arch portion between the bridge portion and the elongate planar portion.

3. An element according to claim 1 characterized in that the laterally-extending portion (650) of the element is provided by the bridge portion.

4. An element according to claim 1 characterized in that the end portions (670) of the leaf-spring portions (610,630) of the element are bent to provide shoe portions which can rub against the surface portions of the corresponding elongate planar portions.

5. A connector for connection to conductive traces on an edge portion of a printed circuit board, the connector comprising first and second spaced, electrically-conductive, resiliently-flexible elements (300,600) each of which comprises three in-line elongate portions (303,307,303,610, 620,630) integrally-formed with a bridge portion (301,640), inwardly-facing, laterally-extending portions (304,650), and a mounting portion (305,605), the elongate portions of the first element providing two coplanar portions (303) and a curved leaf-spring portion (308) extending from the bridge portion (304) toward the second element, and two of the elongate portions of the second element providing a planar portion (620) including said mounting portion (605) and a curved leaf-spring portion, the connector being characterized in that the third elongate portion of the second element (600) is also formed as a curved leaf-spring portion with the planar portion (620) located between the two curved leaf-spring portions (610,630), the construction and arrangement being such that, when the first and second elements are mounted in face-to-face relationship to receive an edge portion of a printed circuit board, the leaf-spring portions (308,610,630) extend to make electrical contact with the planar portion(s) (620,303,303) of the opposed element, and the spacing of the opposed laterally-extending portions (304,650) being such that they are urged apart by insertion, and flex together on extraction, of a circuit board therebetween to cause end portions (307,670) of the leaf-spring portions (308,610,630) to wipe against surface portions of the elongate portions to provide self-cleaning of the contacting surfaces.

6. A connector according to claim 5 characterized in that the laterally-extending portions (304,650) of the first and second elements are formed as arch portions.

7. A connector claim 5 characterized in that each laterally-extending portion (304,650) is provided between a respective elongate planar portion and the respective bridge portion.

8. A connector claim 5, characterized in that each laterally-extending portion (304,650) is provided by the bridge portion of the respective element.

9. Means for connecting circuit means to components on a printed circuit board, said means comprising a plurality of connectors as set forth in claim 5 and arranged in a linear array for receiving and making electrical contact with conductive traces provided along an edge portion of the circuit board and electrically connected with said components.

* * * * *